US005892336A

United States Patent [19]

Lin et al.

[11] Patent Number: 5,892,336

[45] Date of Patent: Apr. 6, 1999

[54] CIRCUIT FOR ENERGIZING COLD-CATHODE FLUORESCENT LAMPS

[76] Inventors: Yung Lin, 2518 Indian Dr., Palo Alto, Calif. 94303; Kwang H. Liu, 714 Jura Way, Sunnyvale, Calif. 94087; John Chou, 297 S. Atlantic Blvd., Unit C, Monterey Park, Calif. 91754

[21] Appl. No.: 132,390

[22] Filed: Aug. 11, 1998

Related U.S. Application Data

[60] Provisional application No. 60/086,821, May 26, 1998.

[51] Int. Cl. [6] ..... G05F 1/00

[52] U.S. Cl. ..... 315/291; 315/239; 315/276; 315/246

[58] Field of Search ..... 315/246, 224, 315/276, 291, 254, 307, 282, 239, 241 R

[56] References Cited

U.S. PATENT DOCUMENTS 5,430,641 7/1995 Kates ..... 363/133

5,615,093 3/1997 Nalbant ..... 315/307 X 5,619,402 4/1997 Liu ..... 315/246 X

*Primary Examiner*—Don Wong

*Assistant Examiner*—Haissa Philogene

*Attorney, Agent, or Firm*—Donald E. Schreiber

[57] ABSTRACT

An electrical circuit for simultaneously energizing at least a pair of CCFLs that are connected in series. The circuit also includes a transformer having a primary winding adapted to receive an alternating current. A secondary winding is coupled in series with the CCFLs to energize their operation. A shunt capacitor, connected in parallel across one CCFL, significantly reduces the peak voltage that must be applied across the CCFLs. Usually, the circuit also includes an isolation capacitor connected in series between the CCFLs and the secondary winding of the transformer. The isolation capacitor provides both DC blocking and electrical isolation between the secondary winding and the CCFLs.

6 Claims, 2 Drawing Sheets

CIRCUIT FOR ENERGIZING COLD-CATHODE FLUORESCENT LAMPS

CLAIM OF PROVISIONAL APPLICATION RIGHTS

This application claims the benefit of U.S. Provisional Patent Application Ser. No. 60/086,821 filed on May 26, 1998.

BACKGROUND OF THE INVENTION

1. Field of the Invention

The present invention relates generally to electrical circuits for supplying electrical energy for energizing cold-cathode fluorescent lamps ("CCFLs") and, more particularly, to electrical circuits for simultaneously energizing at least a pair of CCFLs with electrical energy supplied from a single transformer.

2. Description of the Prior Art

CCFLs are used extensively to provide backlighting for passive displays, particularly for backlighting liquid crystal displays ("LCDs") used with digital computers. However, traditionally such backlighting applications have required only a single CCFL which is generally energized using an electrical circuit such as that illustrated in FIG. 1. As depicted in FIG. 1, for a typical backlighting application an alternating current ("AC") energy source 22 applies electrical energy at a frequency of approximately 20 to 100 kilohertz ("KHz"), and at a comparatively low voltage, e.g. 3.0 to 25.0 volts, across a primary winding 24 of a step-up transformer 26. The transformer 26 also includes a secondary winding 28 that has many more turns than that of the primary winding 24, e.g. 100 times more turns. Thus, the transformer 26 increases the comparatively low voltage AC applied across the primary winding 24 to an approximately 300 to 2,500 volt AC voltage across the secondary winding 28.

To energize operation of a single CCFL 32, the CCFL 32 is connected in series both with the secondary winding 28 of the transformer 26 and with an isolation capacitor 34. The isolation capacitor 34 provides both direct current ("DC") blocking and electrical isolation between the secondary winding 28 and the CCFL 32. For conventional CCFLs 32 used for backlighting computer LCDs, the isolation capacitor 34 usually has a capacitance of approximately 10 to 68 pico-farads ("pf").

When the CCFL 32 is off, i.e. not emitting any light, initially the AC voltage applied across the CCFL 32 rises to a break-down voltage of approximately 1,000 to 1,600 volts. Before the voltage across the CCFL 32 reaches the break-down voltage, the CCFL 32 is in a non-conductive state, i.e. essentially no electrical current flows through the CCFL 32, and only leakage electrical currents flow through the secondary winding 28 and the isolation capacitor 34. When the CCFL 32 breaks-down, enters a conductive state in which an appreciable electrical current flows through the CCFL 32, and the CCFL 32 begins emitting light; the voltage across the CCFL 32 drops to a sustaining voltage of approximately 350 to 600 volts. This phenomenon in which the voltage across the CCFL 32 drops to the sustaining voltage when the CCFL 32 becomes electrically conductive is frequently referred to as negative-impedance. After the CCFL 32 becomes conductive and begins emitting light, the voltage across the isolation capacitor 34 remains essentially constant during an interval which lasts until the AC voltage across the secondary winding 28 drops below the sustaining voltage for some interval of time. Because comparatively high frequency AC energy is supplied to the primary winding 24 of the transformer 26, returning the CCFL 32 to the non-conductive state requires reducing the voltage across the lamp below the sustaining voltage for an interval of time that is much longer than one cycle of the AC voltage across the CCFL 32. When the AC voltage across the secondary winding 28 drops below the sustaining voltage for a sufficiently long interval of time, the CCFL 32 again becomes non-conductive and stops emitting light. During each cycle of the AC voltage after break-down initially occurs, the CCFL 32 conducts electricity twice with electrical current flowing through the CCFL 32 first in one direction during a first sustaining voltage interval, and then in the opposite direction during a second sustaining voltage interval.

Recently, computer displays have begun using larger area LCDs that require using at least two (2) CCFLs 32*a* and 32*b* for proper backlighting. FIG. 2 depicts one circuit that may be used for energizing operation of two (2) CCFLs 32*a* and 32*b* in which the two (2) CCFLs 32*a* and 32*b* are connected in parallel across the secondary winding 28 of the transformer 26 respectively by identical, individual isolation capacitors 34. However, the negative-impedance characteristics of the CCFLs 32*a* and 32*b* implies that the lower, sustaining voltage across the CCFLs 32*a* and 32*b* occurs during intervals in each AC cycle in which a significant electrical current flows through the CCFLs 32*a* and 32*b*. Thus, selection of the isolation capacitors 34*a* and 34*b* becomes very critical in achieving proper operation of the CCFLs 32*a* and 32*b* in the electrical circuit depicted in FIG. 2.

The amount of light produced by each of the CCFLs 32*a* and 32*b* depicted in FIG. 2 depends strongly upon the electrical current flowing through the respective CCFLs 32*a* and 32*b*. The more electrical current flowing through the CCFLs 32*a* and 32*b*, the brighter the light emitted. As set forth below electrical current flows through each of the parallel connected isolation capacitors 34*a* and 34*b* and CCFLs 32*a* and 32*b* in accordance with Kirchoff's voltage law.

$$\overline{V_P}=\overline{V_{C_1}}+\overline{I_1Z_1}=\overline{V_{C_2}}+\overline{I_2Z_2}$$

where $V_P$ is the voltage across the secondary winding 28.

$V_{Ci}$ is the voltage across capacitor "i."

$I_i$ is the current flowing through the CCFL $\mathbf{32}_i$ $Z_i$ is the impedance of the CCFL $\mathbf{32}_i$ The "$\overline{\phantom{x}}$" over each of the parameters represents the phase of AC flowing through the electrical component described by that parameter.

It is readily apparent from the circuit depicted in FIG. 1 and from the preceding equation that either of the two (2) CCFLs 32*a* and 32*b* can "hog" substantially all the electrical current supplied by the secondary winding 28 of the transformer 26. If one (1) of the two (2) CCFLs 32*a* and 32*b* hogs all the current, the life of that particular CCFL 32 will be shortened which correspondingly shortens the life of the pair of CCFLs 32*a* and 32*b*. Correspondingly, if one of the CCFLs 32*a* and 32*b* hogs all the electrical current supplied by the secondary winding 28, then that particular CCFL 32 will be brighter than the other CCFL 32, and backlighting of a LCD will not be uniform.

Another disadvantage of the preceding circuit is that the wire used for the secondary winding 28 of the transformer 26 depicted in FIG. 2 must be significantly larger than that used for the secondary winding 28 depicted in FIG. 1. Normally, the full-rated electrical current for each of the CCFLs 32*a* and 32*b* is approximately 5 milliamperes ("mA") root-mean-square ("rms"). Therefore, the rms electrical current flowing through the secondary winding 28 of the transformer 26 depicted in FIG. 2 is approximately 10 mA rms. To maintain electrical efficiency of the transformer 26, doubling the electrical current flowing through the secondary winding 28 requires doubling the size of the wire used for the secondary winding 28. Doubling the size of the wire used for the secondary winding 28 approximately doubles the size of the transformer 26.

In summary then, the circuit depicted in FIG. 2 for energizing the operation of two CCFLs 32*a* and 32*b*, which is a conventional extension of the circuit depicted in FIG. 1, exhibits the disadvantages that:

1. the size of the transformer 26 increases approximately 1.8 to 2.0 times;
2. it is difficult to design isolation capacitors 34*a* and 34*b* to match with the CCFLs 32*a* and 32*b* under all operating conditions; and
3. the CCFLs 32*a* and 32*b* exhibit non-uniform brightness due to current-hogging which also reduces the life of the CCFLs 32*a* and 32*b*, and the reliability and performance of the electronic system that includes the CCFLs 32*a* and 32*b*.

FIG. 3 depicts another circuit that may be used for energizing operation of two (2) CCFLs 32*a* and 32*b* in which the two (2) CCFLs 32*a* and 32*b* are connected in series with a single isolation capacitor 34 across the secondary winding 28 of the transformer 26. In comparison with the circuit depicted in FIG. 2, the circuit in FIG. 3 ensures that substantially the same electrical current flows through both of the CCFLs 32*a* and 32*b*. Therefore when incorporated into the circuit depicted in FIG. 3, both of the CCFLs 32*a* and 32*b* emit approximately the same amount of light, and operation in the circuit depicted in FIG. 2 does not significantly reduce the life of either of the CCFLs 32*a* and 32*b*.

However, to ensure that the voltage applied to the series connected CCFLs 32*a* and 32*b* exceeds twice the breakdown voltage of the individual CCFLs 32*a* and 32*b*, the output voltage that the secondary winding 28 may apply across the series connected isolation capacitor 34 and CCFLs 32*a* and 32*b* must be twice the output voltage applied by the secondary winding 28 of the transformer 26 depicted in either FIGS. 1 or 2. Consequently, in general the secondary winding 28 of the transformer 26 depicted in FIG. 3 must have twice as many turns as the secondary winding 28 of the transformer 26 depicted either in FIG. 1 or FIG. 2 even though the size of the wire used for the secondary winding 28 remains the same. However, doubling the voltage produced by the transformer 26 not only increases the number of turns required for the secondary winding 28, but also mandates increased electrical insulation to prevent break-down and arcing at the higher peak voltage.

In summary then, the circuit depicted in FIG. 3 for energizing the operation of two CCFLs 32*a* and 32*b*, which is also a conventional extension of the circuit depicted in FIG. 1, exhibits the disadvantages that:

1. the transformer 26 is approximately 1.8 to 2.0 times larger;
2. the voltage rating of the isolation capacitor 34 depicted in FIG. 3 must be two (2) times greater than for the isolation capacitor 34 depicted in FIGS. 1 and 2; and
3. parasitics such as stray capacitances and wire inductance between the CCFLs 32*a* and 32*b* make equalizing the current flowing through each of the CCFLs 32*a* and 32*b* difficult.

BRIEF SUMMARY OF THE INVENTION

The present invention provides an improved electrical circuit for simultaneously energizing at least a pair of CCFLs with electrical energy supplied from a single transformer.

An object of the present invention is to provide an improved electrical circuit for simultaneously energizing at least a pair of CCFLs with electrical energy supplied from a simpler transformer.

An object of the present invention is to provide an improved electrical circuit for uniformly energizing at least a pair of CCFLs with electrical energy supplied from a single transformer.

An object of the present invention is to provide uniform illumination from at least a pair of CCFLs energized with electrical energy supplied from a single transformer.

An object of the present invention is to increase reliability for a pair of CCFLs energized with electrical energy supplied from a single transformer.

Yet another object of the present invention is to provide a high-density power supply for energizing operation of at least a pair of CCFLs.

Yet another object of the present invention is to provide a smaller power supply for energizing operation of at least a pair of CCFLs.

Yet another object of the present invention is to provide a lower-cost power supply for energizing operation of at least a pair of CCFLs.

Yet another object of the present invention is to increase the number of different products that employ multiple CCFLs.

Briefly, an electrical circuit in accordance with the present invention for simultaneously energizing at least a pair of CCFLs includes a first CCFL and a second CCFL that are connected in series. As described above, both the first and second CCFLs respectively have a break-down voltage. The electrical circuit in accordance with the present invention also includes a transformer having a primary winding adapted to receive an AC. A secondary winding of the transformer is coupled in series with the series connected first and second CCFLs to supply an electrical current that energizes operation of both of the series connected CCFLs. The electrical circuit in accordance with the present invention also includes a shunt capacitor that is connected in parallel across the first CCFL. Connection of the shunt capacitor in parallel across the first CCFL significantly reduces the voltage that the secondary winding must apply across the series connected first and second CCFLs, i.e. the voltage becomes significantly less than a sum of the breakdown voltages of the first and second CCFLs.

A particularly preferred embodiment of the electrical circuit in accordance with the present invention also includes an isolation capacitor that connects in series between the series-connected first and second CCFLs and the secondary winding of the transformer. Including the isolation capacitor in the electrical circuit provides both DC blocking and electrical isolation between the secondary winding of the transformer and the CCFLs.

These and other features, objects and advantages will be understood or apparent to those of ordinary skill in the art from the following detailed description of the preferred embodiment as illustrated in the various drawing figures.

DETAILED DESCRIPTION

Figure 3:
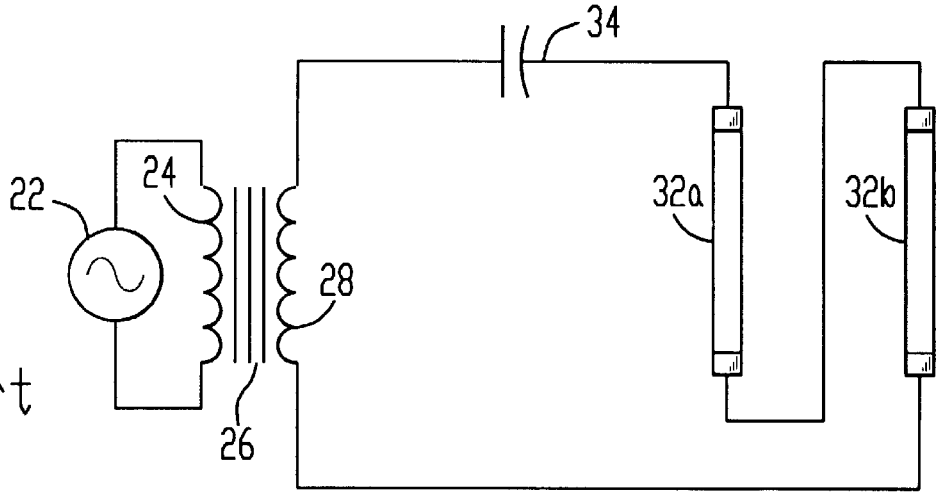
FIG. 3 Prior Art
FIG. 3 is a schematic diagram depicting a prior art circuit that may be used for energizing operation of two CCFLs in which the CCFLs connect in series with a single capacitor across the secondary winding of a transformer.
Figure 4:
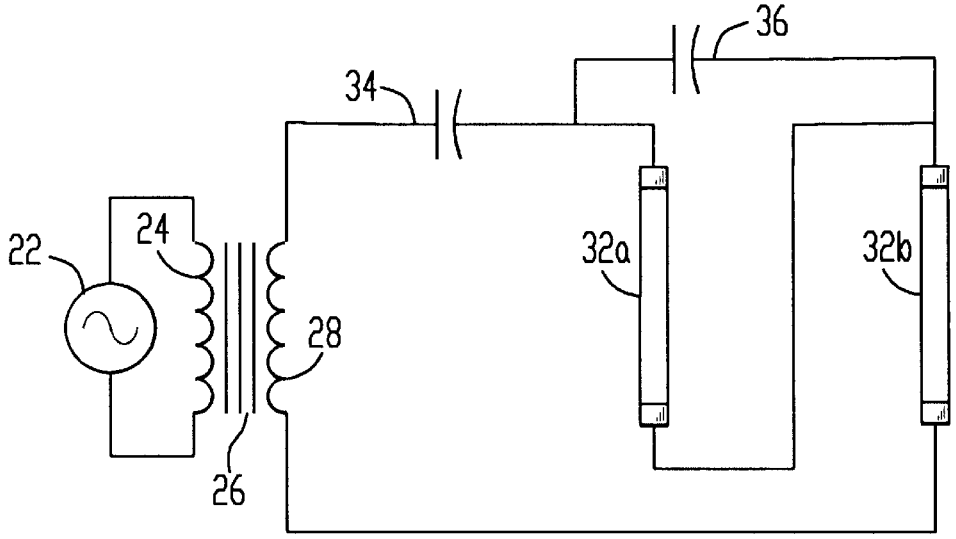
FIG. 4 is a schematic diagram depicting a circuit in accordance with the present invention used for energizing operation of two CCFLs in which the CCFLs connect in series with capacitor across the secondary winding of a transformer, and in which a shunt capacitor connects in parallel across one of the CCFLs.

FIG. 4 depicts a circuit in accordance with the present invention for energizing operation of two CCFLs 32*a* and 32*b*. Similar to the circuit diagram of FIG. 3, in the circuit depicted in FIG. 4 the two (2) CCFLs 32*a* and 32*b* connect in series with a single isolation capacitor 34 across the secondary winding 28 of the transformer 26. However, differing from the circuit diagram of FIG. 3, the circuit depicted in FIG. 4 also includes a shunt capacitor 36 that connects in parallel across one of the CCFLs 32*a* or 32*b*. In the specific embodiment of the present invention depicted in FIG. 4, the shunt capacitor 36 connects in parallel across the CCFL 32*a*. Note that in principle the shunt capacitor 36 could also connect in parallel across the CCFL 32*b*.

The circuit topology depicted in FIG. 4 effectively lowers the impedance of the CCFL 32*a* while it is not conducting. Consequently, while both of the CCFLs 32*a* and 32*b* are in their non-conductive state, most of the voltage appearing across the secondary winding 28 is applied through the isolation capacitor 34 and the shunt capacitor 36 directly across the CCFL 32*b*, and little of the voltage appears across the parallel connected CCFL 32*a* and shunt capacitor 36. Therefore, in the circuit depicted in FIG. 4 the CCFL 32*b* turns-on and becomes conductive first at which time the voltage across the CCFL 32*b* drops almost instantaneously to, and as described above remains at, the sustaining voltage. When the voltage across the CCFL 32*b* drops to the sustaining voltage, the voltage applied across the parallel connected CCFL 32*a* and shunt capacitor 36 increases significantly, after which the CCFL 32*a* turns-on and becomes conductive.

Figure 1:
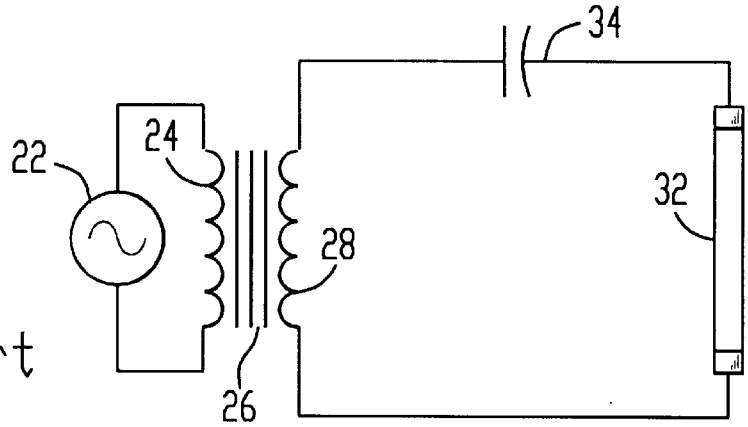
FIG. 1 Prior Art
FIG. 1 is a schematic diagram depicting a prior art circuit that is used for energizing operation of a single CCFL in which the CCFL connects in series with a single capacitor across the secondary winding of a transformer.
Figure 2:
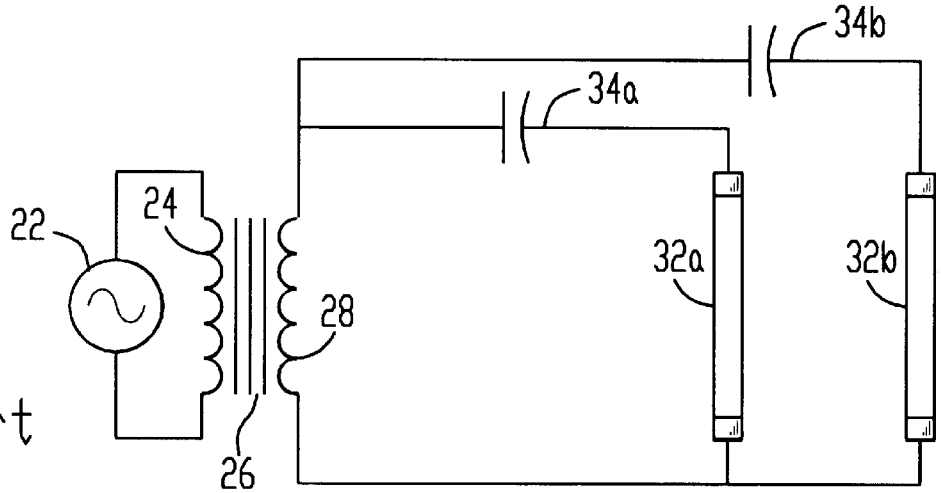
FIG. 2 Prior Art
FIG. 2 is a schematic diagram depicting a prior art circuit that may be used for energizing operation of two CCFLs in which the CCFLs connect in parallel across the secondary winding of a transformer respectively by individual capacitors.

Thus, the circuit topology depicted in FIG. 4 provides a turn-on sequence for the CCFLs 32*a* and 32*b* as described above, the maximum voltage across the secondary winding 28 required for operation of both CCFLs 32*a* and 32*b* need equal only a sum of the break-down voltage of one of the CCFLs 32*a* or 32*b* plus the sustaining voltage of the other CCFLs 32*a* or 32*b*. Consequently, the voltage generated by the secondary winding 28 depicted in FIG. 4 is significantly less than a sum of the break-down voltages of the CCFLs 32*a* and 32*b*. Because the circuit topology depicted in FIG. 4 significantly reduces the maximum voltage across the secondary winding 28, to supply electrical energy for energizing the CCFLs 32*a* and 32*b* the transformer 26 included in the circuit depicted in FIG. 4 need only be approximately 33% larger than the transformer 26 for the circuit depicted in FIG. 1.

Figure 5:
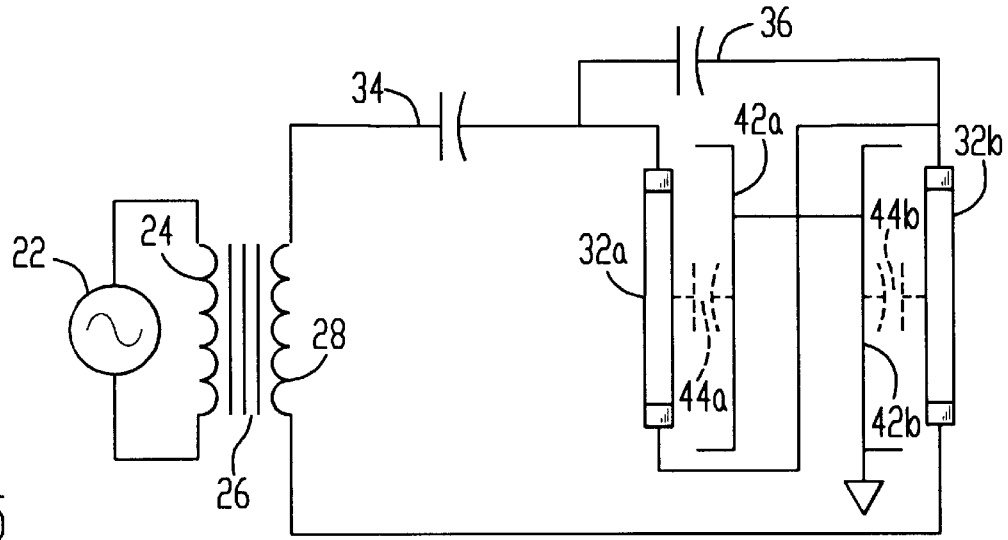
FIG. 5 is a schematic diagram depicting the circuit of FIG. 4 that illustrates parasitic capacitances associated with structures that are adjacent to the CCFLs.

Due to the high-voltage, high-frequency electrical power supplied to the CCFLs 32*a* and 32*b*, parasitic capacitance between the CCFLs 32*a* and 32*b* and adjacent, electrically conductive, structure of an LCD display impose a significant load on electrical power supplied by the transformer 26. FIG. 5 schematically illustrates such adjacent structures 42*a* and 42*b* together with "lumped" parasitic capacitances 44*a* and 44*b* resulting from the structures 42*a* and 42*b*. In addition to applying most of the voltage supplied by the secondary winding 28 to the CCFL 32*b* while the CCFL 32*b* is non-conductive, the shunt capacitor 36 also supplies an electrical current to the CCFL 32*b* that compensates for lost electrical current which flows out of the CCFL 32*a* through the parasitic capacitance 44*a*. Supplying a compensating electrical current through the shunt capacitor 36 better ensures that electrical current flowing through the CCFL 32*b* equals the electrical current flowing through the CCFL 32*a*, and therefore that the two CCFLs 32*a* and 32*b* are equally bright.

Different values of capacitance for the shunt capacitor 36 produce differing intervals between when the CCFL 32*a* becomes electrically conductive after the CCFL 32*b* becomes conductive. The CCFLs 32*a* and 32*b*, which are model CBY3-250N0 marketed by Stanley of Tokyo, Japan, when incorporated into the circuit depicted in FIGS. 4 and 5 operate as follows. When the energy source 22 applies electrical energy at a frequency of 60 KHz to the primary winding 24 and a voltage preferably between 6.0 and 25.0 volts, the shunt capacitor 36 has a value of 5 pf, and the isolation capacitor 34 has a value of 22 pf; the CCFL 32*a* becomes electrically conductive approximately 55.2 milliseconds ("ms") after the CCFL 32*b*. If the shunt capacitor 36 has a value of 15 pf, then the CCFL 32*a* becomes conductive approximately 60.4 ms after the CCFL 32*b*. And if the shunt capacitor 36 has a value of 33 pf, then the CCFL 32*a* becomes conductive approximately 66.8 ms after the CCFL 32*b*. The lower limit of voltage applied across the primary winding 24, 6.g. 6.0 volts, is preferably twice as large as the voltage applied across the primary winding 24 of the transformer 26 depicted in FIG. 1 because the voltage applied by the secondary winding 28 depicted in FIGS. 4 and 5 across the series connected CCFLs 32*a* and 32*b* when conductive and emitting light is approximately twice that which the secondary winding 28 of the transformer 26 depicted in FIG. 1 must apply across the CCFL 32 depicted there.

Figure 6:
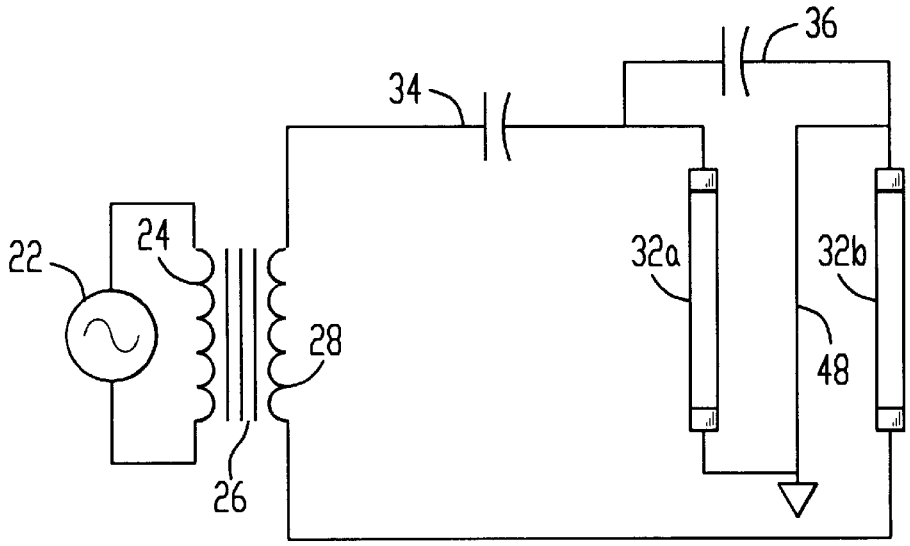
FIG. 6 is a schematic diagram depicting the circuit of FIG. 4 in which a junction between the two CCFLs and the shunt capacitor connects to circuit ground.

In addition to the circuit topology for the present invention illustrated in FIGS. 4 and 5, the present invention may also employ a circuit topology in which a junction 48 between terminals of the two CCFLs 32*a* and 32*b* and the shunt capacitor 36 connects to circuit ground. In general, connection of the junction 48 to circuit ground further delays onset of electrical conduction in the CCFL 32*a*. Thus for the circuit topology depicted in FIG. 6, if the shunt capacitor 36 has a value of 15 pf, then the CCFL 32*a* becomes conductive approximately 83.4 ms after the CCFL 32*b*. And if the shunt capacitor 36 has a value of 20 pf, then the CCFL 32*a* becomes conductive approximately 93.0 ms after the CCFL 32*b*.

Although the present invention has been described in terms of the presently preferred embodiment, it is to be understood that such disclosure is purely illustrative and is not to be interpreted as limiting. For example, the energy source 22 may be any of various different types of electrical circuits, such as a buck regulator that supplies electrical energy to an oscillator, that supplies electrical energy to a push-pull driven inverter which may be either synchronized or unsynchronized, or that supplies electrical energy to an inverter; a current-synchronous, zero-voltage-switching front end circuit; a resonant or any derived resonant circuit; for supplying an alternating current to the primary winding 24. Furthermore, if the energy source 22 is a pure current source, then a circuit in accordance with the present invention may omit the isolation capacitor 34. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. An electrical circuit for simultaneously energizing at least a pair of cold-cathode fluorescent lamps ("CCFLs"), the circuit comprising:

a first CCFL and a second CCFL that are connected in series, each CCFL respectively having a break-down voltage;

a transformer having a primary winding adapted to receive an alternating current ("AC"), and a secondary winding that is coupled in series with said series connected first and second CCFLs, the secondary winding being adapted for supplying an electrical current that energizes operation of both of said series connected CCFLs; and a shunt capacitor that is connected in parallel across said first CCFL, whereby voltage produced by the secondary winding and applied across said series connected first and second CCFLs is significantly less than a sum of the break-down voltages of said first and second CCFLs.

2. The electrical circuit of claim 1 further comprising an isolation capacitor that is connected in series between said series-connected first and second CCFLs and the secondary winding of said transformer.

3. The electrical circuit of claim 1 wherein a junction among terminals of said series connected first and second CCFLs and shunt capacitor is connected to circuit ground.

4. The electrical circuit of claim 1 further comprising energy-supply means for applying electrical energy to the primary winding of said transformer.

5. The electrical circuit of claim 4 wherein said energy-supply means applies electrical energy at a frequency between 20 and 150 kilohertz ("KHz").

6. The electrical circuit of claim 4 wherein said energy-supply means applies electrical energy at a voltage between 6 and 25 volts.

* * * * *

UNITED STATES PATENT AND TRADEMARK OFFICE

CERTIFICATE OF CORRECTION

PATENT NO. : 5,892,336 
DATED : April 6, 1999
INVENTOR(S) : Yung Lin, Kwang H. Liu and John Chou It is certified that error appears in the above-identified patent and that said Letters Patent is hereby corrected as shown below:

Title page,
add, Item [73] Assignee below item [76] Inventors:
-- [73] Assignee O2 Micro International Ltd., Grand Cayman Islands, B.W.I (KY) --

Signed and Sealed this

First Day of April, 2003

JAMES E. ROGAN
*Director of the United States Patent and Trademark Office*